United States Patent [19]

Mobley

[11] Patent Number: 4,674,372

[45] Date of Patent: Jun. 23, 1987

[54] HOLE PUNCH

[75] Inventor: George A. Mobley, Roebuck, S.C.

[73] Assignee: Milliken Research Corporation, Spartanburg, S.C.

[21] Appl. No.: 890,094

[22] Filed: Jul. 28, 1986

[51] Int. Cl.[4] ..... B26F 1/14

[52] U.S. Cl. ..... 83/30; 83/685; 234/107

[58] Field of Search ..... 234/106, 107, 114, 116; 83/684, 685, 691, 30

[56] References Cited

U.S. PATENT DOCUMENTS

| | | | |
|---|---|---|---|
| 2,799,340 | 7/1957 | Mueller | 83/684 X |
| 3,096,015 | 7/1963 | Bradbury | 234/107 |
| 3,299,761 | 1/1967 | Goldman | 234/107 |
| 3,463,042 | 8/1969 | Goldman | 83/627 |
| 3,973,453 | 8/1976 | Tameo | 83/30 |
| 4,123,956 | 11/1978 | Harvey | 83/685 |
| 4,596,359 | 6/1986 | Nordli | 234/107 |

*Primary Examiner*—Jimmy C. Peters

*Attorney, Agent, or Firm*—Earle R. Marden; H. William Petry

[57] ABSTRACT

A pneumatically actuated hole punch which employs a ball and die punching arrangement in which the ball is free floating and the punching impact is between the ball and the plunger rather than between the ball and the die. The plunger incorporates a concave surface to correctly position the ball relative to the die upon cutting of the desired opening.

19 Claims, 4 Drawing Figures

HOLE PUNCH

This invention relates generally to providing a plurality of openings spaced a predetermined distance from one another in a running web of material and in particular to a new and novel pneumatically actuated hole punch.

It is well known in the packaging industry to provide openings at predetermined positions on a running web of material which are closed thereafter to provide easy access to the contents of a package made from such material. Conventionally a running web of material is delivered under a hole punch or hole punches which are actuated by a detector which reads an indicia placed on the material during printing. In one known method, the material web runs over a die and the hole is punched therein by a ball member which cooperates with the edges of the die to cut the hole in the web. It has been found that in this type of hole punch that the service life is limited due to excessive dust accumulation and dulling of the die after a nominal number of punches.

Therefore, it is an object of the invention to provide an automatic hole punch for a web of material or like material which has an extended service life and does not readily accumulate dust.

Other objects and advantages of the invention will become readily apparent as the specification proceeds to describe the invention with reference to the accompanying drawing, in which.

Figure 1:
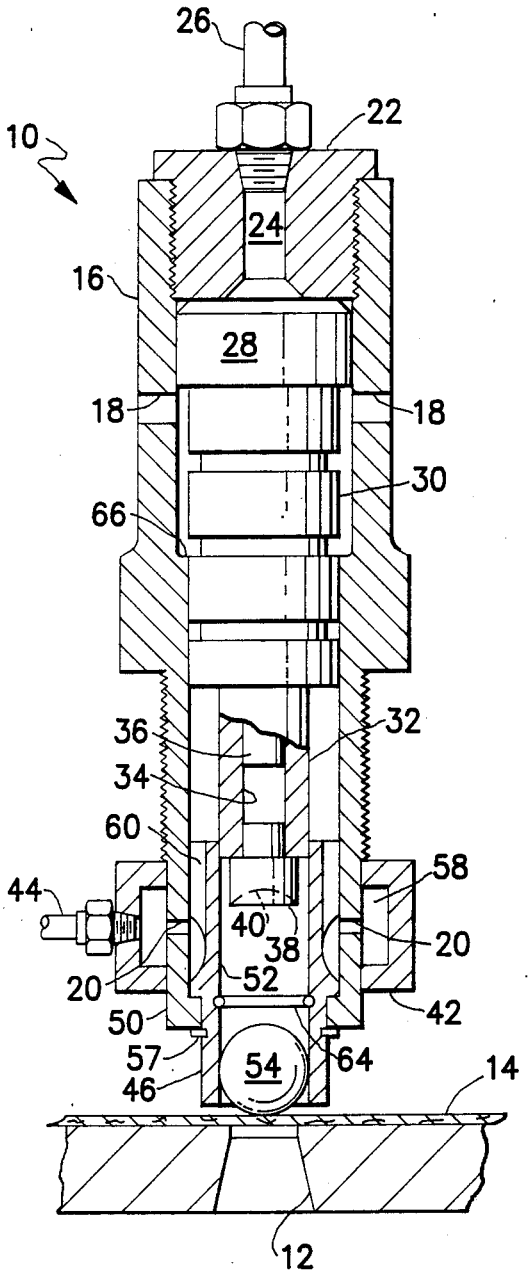
FIG. 1 is a partial sectional view of the new and novel hole punch arrangement.

Looking now to FIG. 1, the hole punch 10 is shown cooperating with a cutting die 12 to punch or cut a hole in the running web of material 14. It is understood that a series of hole punches can be employed across a wide sheet of material or a single punch can be employed on a narrow width of material. The number and position of the hole punches is not considered part of the invention.

The hole punch 10 has a housing 16 through which a plurality of exhaust openings 18 and inlet openings 20 are drilled or otherwise formed. Screwed to the upper end of the punch housing 16 is an end cap 22 with an opening 24 therein in communication with an air conduit 26 supplied with air under pressure. In the position shown in FIG. 1, the piston 28 abuts the end cap 22. Adjacent to and moved by the piston 28 is the plunger 30 which has a plunger stem 32 of brass or other suitable material connected thereto. Mounted in an opening 34 in the plunger stem 32 is a magnet 36, for reasons hereinafter explained, and a steel plunger tip 38 having a concave surface 40 at the end thereof. Surrounding the lower portion of the punch housing 16 is an air collar 42 supplied with air under pressure from the conduit 44 to feed air through the openings 20 and upwardly through the grooves 60 into the interior of the housing 16.

Figure 2:
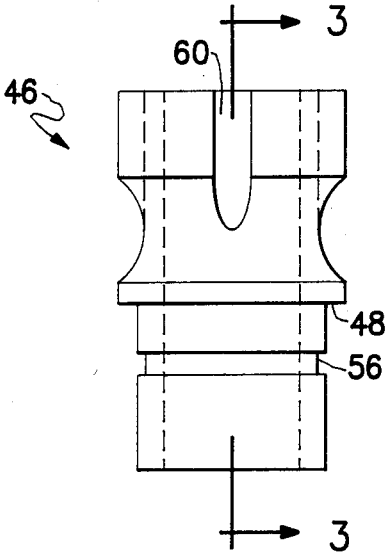
FIG. 2 is an enlarged view of the ball guide shown in FIG. 1.
Figure 3:
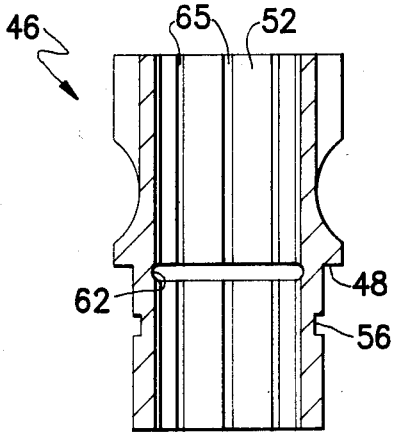
FIG. 3 is a cross-section view taken on line 3—3 of FIG. 2.
Figure 4:
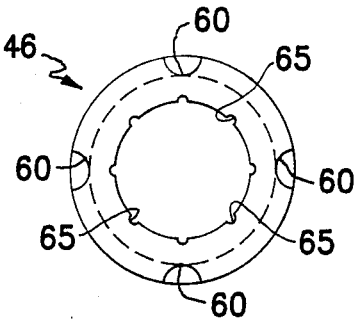
FIG. 4 is a top view of the ball guide shown in FIG. 2.

As shown in FIG. 1 and in detail in FIGS. 2 through 4, a ball guide 46 is mounted in the housing 16 with the flange portion 48 abutting the interior internal end 50 of the housing 16. The ball guide 46 has opening 52 therethrough to accommodate the ball 54 at one end and the reciprocating plunger at the other end. An annular groove 56 is cut in the outer surface of the ball guide 46 to accommodate a retaining ring 57 to prevent the ball guide 46 from being lifted out of contact with the interior internal surface of housing 16. An inner annular groove 62 is found on the inside of the ball guide 46 to accommodate a metal ring 64 to restrict the upward movement of the ball 54. Internal lengthwise grooves 65 in the bore 52 of the ball guide serve three functions: (1) prevents an increase in air pressure when the plunger moves down, (2) presents an interrupted surface to the ball 54 to scrape off any dust or contamination adhering to the ball, and (3) gives a passage for a momentary flow of air to blow out any dust or contamination which has been removed from the ball.

OPERATION

In operation, the web of material 14 is continuously supplied over the die 12 and air under low pressure is supplied into the chamber 58 from the conduit 44 to maintain the piston 28 and the plunger 30 in the upward position. When the hole punch indicia is read on the web prior to passing over the die 12, a signal is supplied to a solenoid valve (not shown) to allow a short pulse of air under pressure to be delivered to the conduit 26. The air pressure in the conduit 26 is substantially higher than the pressure of the air delivered through the conduit 44.

The short pulse of high pressure air in the conduit 26 acts against the piston 28 to cause it and the plunger 30 to be driven downwardly at high speed until the bottom of the piston 28 bottoms out on the flange 66 on the inner surface of the housing 16. When the piston bottoms out and the short pulse of air is exhausted through the openings 18, the plunger 30 continues to move downwardly due to inertia until the concave surface 40 of the plunger tip 38 strikes the ball 54. Since the ball 54 is resting on the web of material 14 centered over the hole in the die 12 when the plunger tip strikes the ball, the potential energy of the plunger drives the ball against the die thereby cutting a hole in the web.

Since the pulse of air is now exhausted through the openings 18 and the plunger is stopped by the ball 54, the air from the conduit 44 passes upward through the grooves 60 to raise the plunger 30 to push it upwardly against the piston 28 until the piston 28 contacts the cap 22. As the plunger 30 is raised the magnet 36 exerts a force on the ball 54 to raise it until the ring 64 separates the ball 54 from the plunger tip 38 to allow it to fall back onto the web. Once the piston is raised to the point where it contacts the cap 22, the hole punch is ready to punch another hole in the web.

It is obvious that a hole punch is described which will efficiently punch a hole in a moving web of material which does not excessively wear the die since no positive, continuous force is exerted on the ball and at the same time prevents wrinkling of the material due to the positive force of the magnet lifting the ball off the web as the material slides under the hole punch.

Although the preferred embodiment of the invention has been described in detail, it is contemplated that many changes may be made without departing from the scope or spirit of the invention and it is desired that the invention only be limited by the claims.

I claim:

1. A method to provide an opening through a running web of material comprising the steps of: passing the web of material between a ball member and a die, cutting an opening through the web material by propelling the ball member into the die, lifting the ball member off the web material after the opening has been cut and allowing the ball member to fall onto the web material in a position opposite to the die.

2. The method of claim 1 wherein the ball member is magnetically lifted off the web material.

3. The method of claim 2 wherein the ball member is released to fall onto the web material by obstructing the upward movement of the ball member as the ball propelling member is lifted.

4. A punch and die arrangement to perforate a running web of material between a fixed die element having a hole therein and a punch element having a freely mounted ball member therein aligned with the hole in said fixed die element, said punch element comprising: a housing, a piston member slidably mounted in upper portion of said housing, a plunger member slidably mounted in said housing below said piston, a ball guide member mounted in said housing below said plunger member having an opening therethrough, said ball member located in said opening in said ball guide member, means operably associated with said housing to continuously supply low pressure air under said plunger member and means to periodically supply a short high pressure air pulse to the top of said piston to slide said piston and said plunger member downwardly to cause said plunger member to force said ball member downwardly towards said die member to cut an opening in said web of material.

5. The arrangement of claim 4 wherein said plunger member includes a magnet to attract said ball member when said plunger member is moved upwardly by said low pressure air.

6. The arrangement of claim 5 wherein said ball guide member includes a ring member mounted in the opening therein to cause said ball member to be separated from the force of said magnet.

7. The arrangement of claim 6 wherein said plunger member has a concave surface on the lower end thereof to engage said ball member.

8. The arrangement of claim 4 wherein said housing member includes a plurality of openings in the walls of the upper portion thereof to exhaust the high pressure air after the piston has been slid downwardly past the plurality of openings.

9. The arrangement of claim 8 wherein said plunger member includes a magnet to attract said ball member when said plunger member is moved upwardly by said low pressure air.

10. The arrangement of claim 9 wherein said ball guide member includes a ring member mounted in the opening therein to cause said ball member to be separated from the force of said magnet.

11. The arrangement of claim 4 wherein said ball guide member has a plurality of grooves in the outer wall thereof in communication with the source of low pressure air to guide the lower pressure air in a direction upward towards said plunger member.

12. The arrangement of claim 11 wherein said housing member includes a plurality of openings in the walls of the upper portion thereof to exhaust the high pressure air after the piston has been slid downwardly past the plurality of openings.

13. The arrangement of claim 12 wherein said plunger member includes a magnet to attract said ball member when said plunger member is moved upwardly by said low pressure air.

14. The arrangement of claim 13 wherein said ball guide member includes a ring member mounted in the opening therein to cause said ball member to be separated from the force of said magnet.

15. The arrangement of claim 4 wherein said ball guide member has a plurality of internal grooves therein extending lengthwise to allow small amounts of air to blow past said plunger member onto said ball member.

16. The arrangement of claim 9 wherein said ball guide member has a plurality of internal grooves therein extending lengthwise to allow small amounts of air to blow past said plunger member onto said ball member.

17. A punch and die arrangement to perforate a running web of material between a fixed die element and a punch element having a free mounted ball member therein aligned with the hole in the fixed die element, said punch element comprising: a housing, a cap on top of said housing having an opening therethrough, an air conduit connected to said opening to supply pulses of high pressure air into said housing, a piston slidably mounted in said housing adjacent said cap, air exhaust openings in the walls of the upper portion of said housing adjacent said piston, a plunger member slidably mounted in said housing below and operably associated with said piston, said plunger member having a magnet therein in the lower portion thereof, a ball guide member mounted in the bottom of said housing having an opening therethrough in which said ball member is freely mounted, said ball guide member having grooves in the outer wall thereof communicating with a bottom portion of said plunger member, at least one air inlet opening in the side walls of said housing adjacent said grooves in said ball guide member and means to continuously supply low pressure air through said air inlet opening to raise said plunger member and said piston when the high pressure air pulse is exhausted through said air exhaust openings.

18. The arrangement of claim 17 wherein said ball guide member has a plurality of internal grooves therein extending lengthwise to allow small amounts of air to blow past said plunger member onto said ball member.

19. The arrangement of claim 15 wherein said plunger member has a concave surface on the lower end thereof to engage said ball member.

* * * * *